United States Patent [19]

Wilhelm

[11] 4,164,598

[45] Aug. 14, 1979

[54] VENEER WALL COVERING AND METHOD OF ASSEMBLY

[75] Inventor: William D. Wilhelm, St. Charles, Mo.

[73] Assignee: Interior Brick Corporation, Maryland Heights, Mo.

[21] Appl. No.: 899,475

[22] Filed: Apr. 24, 1978

Related U.S. Application Data

[62] Division of Ser. No. 781,759, Mar. 28, 1977, abandoned.

[51] Int. Cl.[2] ..... B32B 3/14; B32B 3/16; B32B 9/04; E04C 1/00

[52] U.S. Cl. ..... 428/48; 428/15; 428/538; 52/309.1; 52/306

[58] Field of Search ..... 428/15, 48, 538; 52/745, 747, 306, 309.1

[56] References Cited

U.S. PATENT DOCUMENTS

| | | | |
|---|---|---|---|
| 2,035,761 | 3/1936 | Reese | 156/278 X |
| 3,350,827 | 11/1967 | Sugar | 52/747 X |
| 3,518,799 | 7/1970 | Bachner | 52/309.1 X |
| 3,555,757 | 1/1971 | Volent | 52/390 |
| 3,594,968 | 7/1971 | Johnson | 52/390 |
| 3,613,326 | 10/1971 | Mollman | 52/309.1 X |
| 3,621,625 | 11/1971 | Medow | 52/309.1 X |
| 3,660,214 | 5/1972 | Nichols, Jr. et al. | 428/48 |
| 3,712,825 | 1/1973 | Yocum | 428/48 X |
| 3,809,595 | 5/1974 | Nichols, Jr. et al. | 156/267 |
| 3,884,737 | 5/1975 | Bransford, Jr. | 156/63 |
| 4,001,361 | 1/1977 | Unruh | 52/309.1 X |
| 4,031,282 | 6/1977 | McClinton | 428/538 X |

*Primary Examiner*—George F. Lesmes
*Assistant Examiner*—Daniel R. Zirker
*Attorney, Agent, or Firm*—Gravely, Lieder & Woodruff

[57] ABSTRACT

A veneer wall covering to simulate a brick wall through the provision of adhering a plurality of thin blocks formed from dry wall sheet stock to an interior wall in any known brick layup patterns, applying a coating over the blocks to produce a textured surface which duplicates the texture of bricks, followed by applying a desired color selected from the prevailing color or real brick, or variations thereof.

3 Claims, 4 Drawing Figures

VENEER WALL COVERING AND METHOD OF ASSEMBLY

This is a division of application Ser. No. 781,759, filed Mar. 28, 1977, now abandoned.

BACKGROUND OF THE INVENTION

Trends in interior wall construction and coverings range from brick to plaster walls to dry walls, to stucco, and to stone. It is, of course, well known to apply burlap to give a certain pleasing texture, or to apply paper which has been printed with any of a variety of designs ranging from murals to plain colors. Interior wall coverings also include panelling sheets that are prepared to simulate a variety of surfaces. The availability of wall covering materials is quite varied and include clay or ceramic blocks in the shape of real brick but quite thin to reproduce a brick wall texture. Wall coverings of the latter type are very heavy and also are limited as to color and surface texture treatment.

BRIEF DESCRIPTION OF THE INVENTION

This invention is directed to veneer wall covering and to the method of assembly of the veneer on an interior wall.

The objects of this invention are to provide an interior wall covering made up of blocks to simulate a brick layup, to initiate the wall covering with plain undecorated surfaces on the veneer blocks, to provide a wall covering that is capable of yielding to any of a variety of attractive surface texture and color treatments, to provide a simulated brick wall covering that is durable, fire retarding and water resistant, and to provide a simulated brick wall covering system that is versatile as to color treatment, economical to install and flexible enough to be applied to other than flat walls.

The preferred embodiment of the present invention comprises reducing standard smooth surface gypsum dry wall panels or sheets to the normal size of any of the available bricks, adhering the individual bricks to an interior wall, applying a coating to the layup to transform the surface of the individual bricks to a brick texture condition and to reproduce a mortar appearance between bricks, and finally to add a color treatment to the bricks without changing the mortar appearance.

BRIEF DESCRIPTION OF THE DRAWINGS

The present invention is illustrated in the accompanying drawings, wherein.

DETAILED DESCRIPTION OF THE INVENTION

Figure 1:
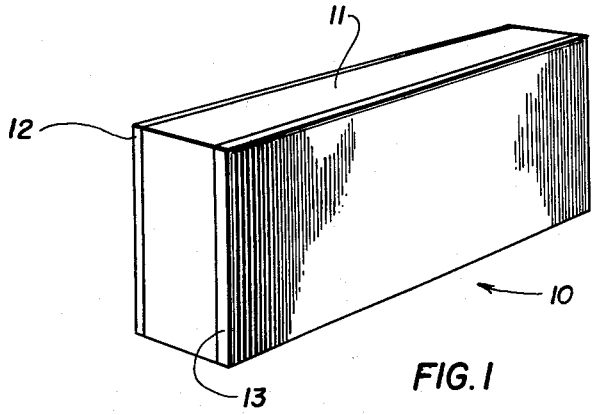
FIG. 1 is a greatly enlarged individual brick formed from dry wall sheet stock which is typical of the present invention.

A durable light weight and easily formed simulated brick block may be formed by cutting a sheet of dry wall plaster or gypsum board into brick sizes, thereby providing thin bricks ready to be applied in the raw or untreated condition. It is preferred to use gypsum board that is one fourth inch thick and covered on both front and rear with a heavy paper.

The wall of a room is to be covered with the simulated bricks is prepared by removing dirt and loose wall paper, and repairing cracks and the like. The wall is thin coated with an adhesive, a small area at one time, and the back side of the blocks are also coated with the same adhesive before they are pressed into position on the adhesive applied to the wall. This procedure is followed until the wall area chosen has been covered with the blocks in properly spaced relation and arranged to simulate a regular running bond. Other layup may be selected to simulate a coursed ashlar, stacked bond, basket weave, or any other pattern that may be thought of.

The layup of the simulated brick forms a veneer over the base wall and the preferred adhesive is of the contact type that will hold under the most adverse conditions, it being preferred to use The Swift Co. adhesive No. 44252, which is a rubber base contact adhesive. The blocks are then coated with a material which can produce a variety of brick like textures on the block surfaces and to the space between blocks that simulate the usual mortar joints. The coating in the joints can be smoothed off with an appropriate tool or brush so its finished appearance is different from the faces of the blocks. An extremely rought texture can be produced on the block faces by several coats of the material, or by dabing the faces with the applicator to raise ridges, points and highlight the surface. This coating can be Simplex 100 which is a heavy acrylic latex paint coating.

Once the coating has dried or set, the wall can be painted to what ever color has been selected. Care must be exercised not to run the paint coat into the joints, and this can be achieved by the use of a roller type applicator directed diagonally of the horizontal and vertical joints. The paint may be applied so as to form an even coating or layer, or it may be applied in such a way that the result gives a mottled effect. It is also effective to lightly roll the painted surfaces with a darker or lighted color paint to develop a weathered look or to obtain a highlighted effect on the peaks of the rough texture. The painted coating can be water resistant, such as acrylic latex paints.

The blocks, the adhesive, the coating materials and the applicators, brushes and necessary tools can be made up in kits with directions on how to apply the blocks, coat the same and apply the final paint coat. When made up in kits, the block veneer can be plain so that the purchaser will be able to select the color desired, and the blocks in all kits do not have to be given any special treatment. Thus, there is obtained economy of making up the kits or packages of blocks, the blocks lend themselves to a variety of decorative effects. Colors may be changed from time to time merely by painting over the original coating. An important advantage is that there is no requirement to supply pre-colored or pre-treated blocks to simulate bricks.

In the drawings FIG. 1 illustrates a typical individual brick 10 which is cut from sheet stock and includes a gypsum core 11 having a backing paper sheet 12 and a face paper sheet 13. The dimensions of the body 10 can be those of a standard brick insofar as length and heighth is concerned. The thickness of the body is primarily determined by the thickness of the core 11.

Figure 2:
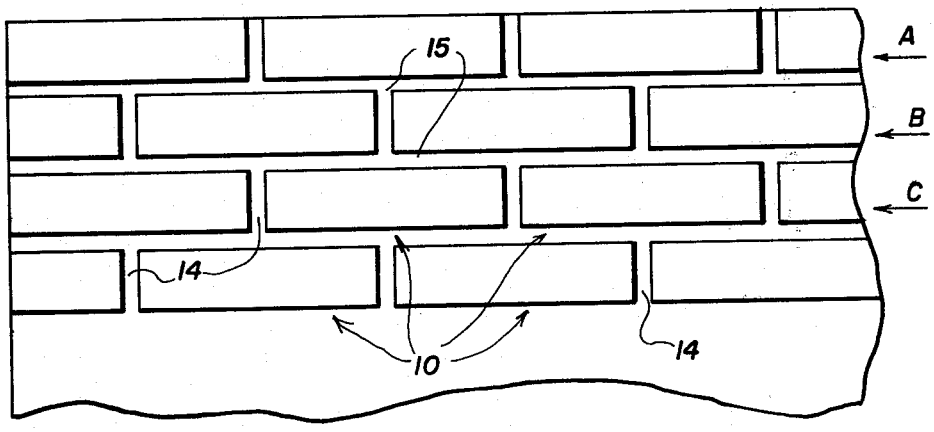
FIG. 2 is a fragmentary portion of a wall to which the blocks of FIG. 1 have been applied to simulate a brick wall.

FIG. 2 illustrates a veneer of bodies 10 in a typical running bond brick layup in which the first course A of the bodies 10 are spaced apart to provide a simulated mortar space 14. The next adjacent course B is layed up in which the bodies 10 are lapped under the bodies 10 of the course A, and again mortar spaces 14 are provided as in a standard brick layup. The courses A and B are spaced vertically to provide a continuous mortar gap 15. Subsequent courses, as course C, are layed up in a running bond pattern until the wall surface 16 has been covered with a veneer of individual bodies 10 to simulate a brick wall layup. Each body 10 is in the raw condition as it is cut from the gypsum dry wall sheet material, thereby leaving the layup on the wall 16 in a rough raw condition.

Figure 3:
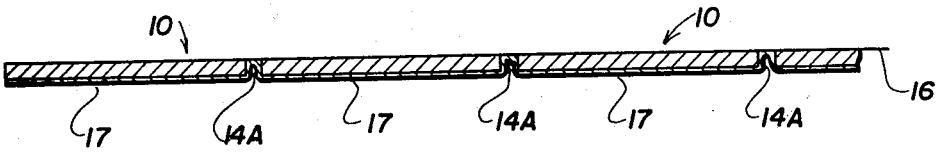
FIG. 3 is a fragmentary sectional view of a plurality of bricks adhered to a wall and given a first coating to produce a desired texture for the exposed surface of the blocks and the mortar gap which exposes the wall between blocks.

Referring now to FIG. 3 there is shown in a fragmentary enlarged section a plurality of bodies 10 which have been adhesively applied to the surfaces of wall 16. A first coating 17 is applied over the bodies 10 as well as within the mortar gaps 14 so as to cover all of the exposed surfaces and edges of the blocks and wall with the material that can be textured to simulate the natural rough surface of real bricks. The mortar gaps 14 may be separately treated to smooth the innermost or recessed surface 14A so as to duplicate the appearance of the mortar gaps in a real brick wall layup. The coating 17 may be any suitable type, such as acrylic latex material which is applied liberally so as to hide all roughness, score marks and misalignment. The material is applied by brush which can be manipulated by dobbing so as to produce irregular raised surface portions which reproduce an extremely rough texture. If a less rough texture is desired the applicator brush can be wiped parallel with the block surfaces, or a straight edge can be wiped over the coating 17 to knock down the rough texture raised by the dobbing technique.

Figure 4:
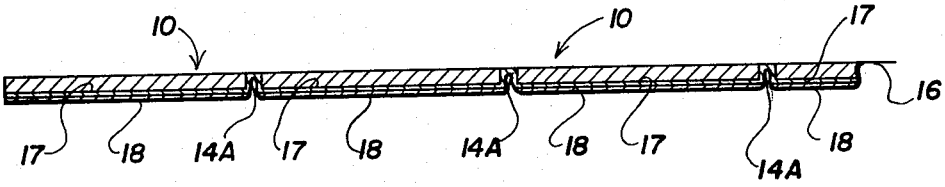
FIG. 4 is a view similar to FIG. 3 to show a second coating applied to the exposed surfaces of just the bricks.

As shown in FIG. 4, after the coating 17 has set up or dried, a color coat 18 can be applied so as to produce a color contrast between the surfaces covered by the coating 18 and the mortar spaces 14A. In applying the color coat 18, care must be exercised to prevent the color coat running into the mortar gap spaces 14. It has been found that using a roller applicator and running it diagonally across the bodies 10 color run can be effectively prevented. In some instances surface highlights will be found desirable, which surface appearance can be obtained by lightly applying, by roller or brush, a different color which will strike the high areas of the textured surface of coating 17 which have been covered by the coating 18. A certain amount of artistry needs to be exercised in producing a pleasing highlight effect.

The overall results obtained by the present invention are economy in first coat, fire resistance wall covering veneer, water resistant and durable materials, easy installation and the ability to reproduce the looks, feel, warmth, and texture of real brick without its weight or bulk.

What is claimed is:

1. In a veneer wall covering of individual blocks for interior walls of a building to produce a three dimensional effect, the improvement comprising: a plurality of blocks of light weight paper backed gypsum adhesively applied to the existing surface of the interior wall and to project therefrom, said blocks being arranged in spaced relation to expose the surface of the existing wall in the spaces between said blocks; a layer of a plastic texturizing covering material applied over said blocks and in the spaces between said blocks to cover the block edges and the exposed surface of the existing wall to thereby simulate conventional mortar joints and a final finishing pigmented coat applied solely to the faces of said blocks whereby said blocks are made to stand out relative to said spaces between said blocks.

2. The veneer wall covering improvement set forth in claim 1 characterized in that said layer of plastic covering material has a thickness consistency in the face areas of each of said blocks to produce a rough surface texture having irregular raised surface portions.

3. The veneer wall covering improvement set forth in claim 1 characterized in that said layer of plastic covering material and said final finishing coat applied to the faces of said blocks over said plastic covering material have color contrast characteristics.

* * * * *